US008070084B2

(12) United States Patent
Biggin et al.

(10) Patent No.: US 8,070,084 B2
(45) Date of Patent: Dec. 6, 2011

(54) SPIDER HAVING SPIDER ARMS WITH OPEN CHANNEL

(75) Inventors: David Francis Biggin, Burlington, WI (US); Walter Ray Marks, Greendale, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 1 day.

(21) Appl. No.: 12/700,877

(22) Filed: Feb. 5, 2010

(65) Prior Publication Data

US 2011/0192927 A1 Aug. 11, 2011

(51) Int. Cl.
*B02C 2/06* (2006.01)

(52) U.S. Cl. ..... 241/209

(58) Field of Classification Search ..... 241/209–216
See application file for complete search history.

(56) References Cited

U.S. PATENT DOCUMENTS

| | | | | |
|---|---|---|---|---|
| 2,832,547 | A * | 4/1958 | Kennedy | 241/209 |
| 3,456,889 | A | 7/1969 | Burkhardt et al. | |
| 3,774,857 | A | 11/1973 | Decker et al. | |
| 3,813,047 | A | 5/1974 | Torrence et al. | |
| 3,908,915 | A | 9/1975 | Milenkovic | |
| 4,037,800 | A | 7/1977 | Coxhill | |
| 4,172,339 | A | 10/1979 | Balz | |
| 4,339,087 | A | 7/1982 | Pollak | |
| 4,391,414 | A | 7/1983 | Reiter | |
| 5,035,368 | A | 7/1991 | Finley et al. | |
| 5,152,468 | A * | 10/1992 | Virtamo et al. | 241/213 |
| 5,350,125 | A | 9/1994 | Clark | |
| 5,810,269 | A | 9/1998 | Shannon | |
| 5,934,583 | A * | 8/1999 | Jean | 241/210 |
| 6,536,694 | B2 | 3/2003 | Van Mullem | |
| 6,772,970 | B2 | 8/2004 | Davis et al. | |
| 7,195,186 | B2 | 3/2007 | Van Mullem | |
| 2002/0170994 | A1 | 11/2002 | Van Mullem | |
| 2005/0269436 | A1 | 12/2005 | Sawant et al. | |

OTHER PUBLICATIONS

"Nordberg Superior Gyratory Crushers" Metso Minerals, Brochure No. 1253-01-02, 2002, pp. 1-12.

* cited by examiner

*Primary Examiner* — Faye Francis
(74) *Attorney, Agent, or Firm* — Andrus, Sceales, Starke & Sawall, LLP

(57) ABSTRACT

A spider for use with a gyratory crusher. The spider includes spider arms each formed from two spaced flanges joined by a connecting web to define an open channel having an open top end. The configuration of the spider arms increases manufacturability and provides the required strength and rigidity for the spider. The channel formed in each spider arm is covered by a spider arm shield to reduce abrasive wear to the spider arm.

9 Claims, 7 Drawing Sheets

18
11
12
16
20
14
22
10
24

SPIDER HAVING SPIDER ARMS WITH OPEN CHANNEL

BACKGROUND OF THE INVENTION

The present disclosure generally relates to a rock crushing machine, such as a rock crusher of configurations commonly referred to as gyratory or cone crushers. More specifically, the present disclosure relates to a spider for use in a gyratory crusher or cone crusher including multiple spider arms each including an open channel formed between two spaced flanges.

Rock crushing machines break apart rock, stone or other materials in a crushing cavity formed between a downwardly expanding conical mantle installed on a mainshaft that gyrates within an outer upwardly expanding frustoconically shaped assembly of concaves inside a crusher shell assembly. The conical mantle and the mainshaft are circularly symmetric about an axis that is inclined with respect to the vertical shell assembly axis. These axes intersect near the top of the rock crusher. The inclined axis is driven circularly about the vertical axis thereby imparting a gyrational motion to the mainshaft and mantle. The gyrational motion causes points on the mantle surface to alternately advance toward and retreat away from the stationary concaves. During retreat of the mantle, material to be crushed falls deeper into the cavity where it is crushed when motion reverses and the mantle advances toward the concaves.

A spider is attached to the top of the shell assembly, forming the top of the support structure for the mainshaft. The material to be crushed is typically dropped onto an abrasion resistant spider arm shields that are positioned over the arms and central hub of the spider, after which the material to be crushed falls into the crushing cavity. The spider includes a central hub and bushing that receive one end of the mainshaft. The crushing forces generated in the crushing cavity create very large loads that are imposed in part on the spider. The spider must be constructed to withstand such loads to avoid having to shut down a crushing line, or an entire mine, to replace and/or repair a damaged spider.

SUMMARY OF THE INVENTION

The present disclosure relates to a gyratory crusher including a spider for use in breaking rock, stone, or other materials in a crushing cavity. The spider formed in accordance with the present disclosure includes a central hub and bushing that receives one end of a gyrating mainshaft positioned within a shell assembly of the crusher. A plurality of spider arms, typically two, extends from the central hub to an outer rim to support the central hub generally along a center axis of the crusher. Each spider arm is fitted with a spider arm shield to protect the spider arm from rocks and debris during use.

Each of the spider arms is formed from a pair of generally vertically oriented flanges with an underlying web to define a channel. The channel formed between the pair of flanges is open to the top.

In an embodiment in which the channel is open vertically upward, the pair of flanges and the web form a connecting beam between the central hub and the outer rim of the spider. The connecting beam that forms each of the spider arms has a shear center typically below the connecting web of the beam. Such configuration minimizes damaging torsional stresses that characteristically reduce the strength of open sections relative to closed sections of a similar size.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
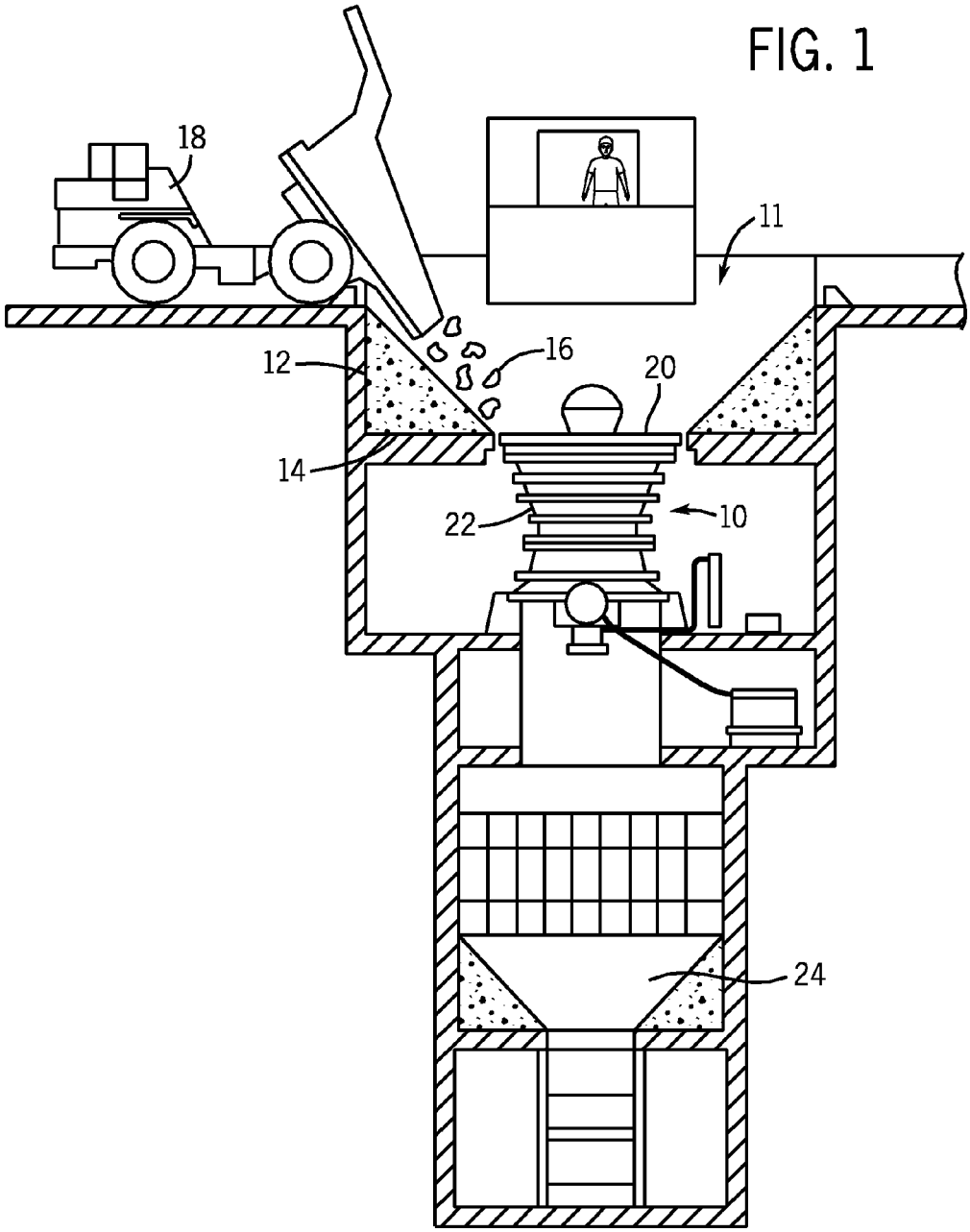
FIG. 1 is a schematic illustration of a gyratory rock crusher.

FIG. 1 illustrates the general use of a rock crushing system 11. As illustrated in FIG. 1, a gyratory rock crusher 10 is typically positioned within a pit 12 having a bottom wall 14. The pit 12 receives a supply of material 16 to be crushed from various sources, such as a haul truck 18. The material 16 is deposited into the pit 12 and is directed toward the top of a crushing cavity positioned below the upper feed end 20 of the rock crusher 10. The material 16 enters the crushing cavity and passes through the concave assembly positioned along the stationary shell assembly 22. Within the shell assembly, a crushing mantle (not shown) gyrates and crushes the material within the crushing cavity. The crushed material exits the gyratory rock crusher 10 and enters into a receiving chamber 24 where the crushed material is then directed away from the rock crushing system 11, such as through a conveyor assembly or other transportation mechanisms. The operation of the rock crushing system 11 is conventional and has been utilized for a large number of years.

Figure 2:
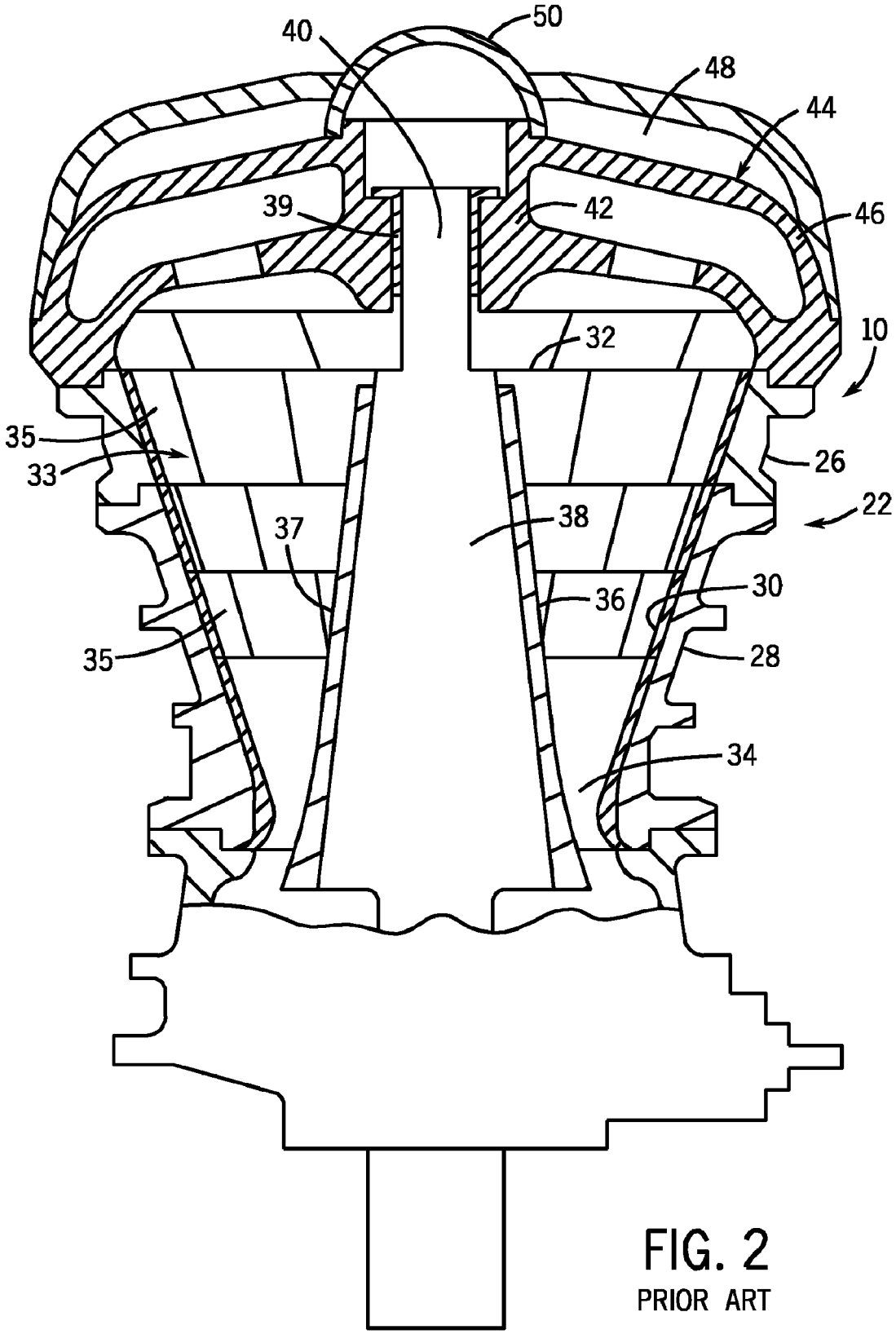
FIG. 2 PRIOR ART
FIG. 2 is a section view of a prior art gyratory rock crusher including a prior art spider.

FIG. 2 illustrates a cross-section view of the gyratory rock crusher 10 of the prior art. As illustrated in FIG. 2, the gyratory rock crusher 10 typically includes the shell assembly 22 formed by an upper top shell 26 joined to a top shell 28. The rows of concaves 35 positioned along the inner surface of the shell assembly 22 define a generally tapered frustoconical inner surface 30 that directs material from the open top end 32 downward through a converging crushing cavity 33 formed between the inner surface 30 defined by the rows of concaves 35 and an outer surface 36 of a frustoconical mantle 37 positioned on a gyrating mainshaft 38. Material is crushed over the height of the crushing cavity 33 between the inner surface 30 and the outer surface 36 as the mainshaft gyrates, with the final crushing at the crushing gap 34.

The upper end 40 of the mainshaft 38 is supported in a bushing 39 contained within a central hub 42 of a spider 44. The spider 44 is mounted to the upper top shell 26 and includes at least a pair of spider arms 46 that support the central hub 42, as illustrated. In the embodiment illustrated, a pair of spider arm shields 48 are each mounted to the spider arms 46 to provide wear protection. A spider cap 50 mounts over the central hub 42, as illustrated.

Figure 3A:
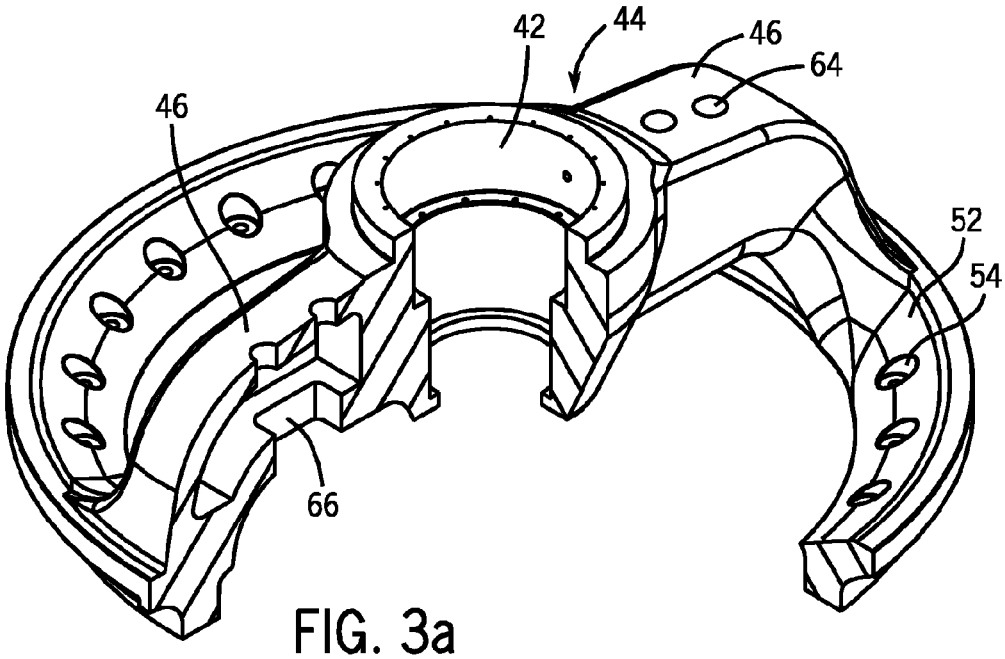
FIG. 3a PRIOR ART
FIG. 3*a* is a partial cross-section view of a prior art spider.

FIG. 3*a* provides a detailed view of the prior art spider 44 used in the gyratory rock crusher 10 shown in FIG. 2. As illustrated in FIG. 3*a*, the spider 44 includes the central hub 42 integral with a pair of spider arms 46. Each of the spider arms 46 extends outward and is joined to an outer rim 52 that includes a series of mounting holes 54 for attaching the spider 44 to the upper top shell 26, as described.

Figure 3B:
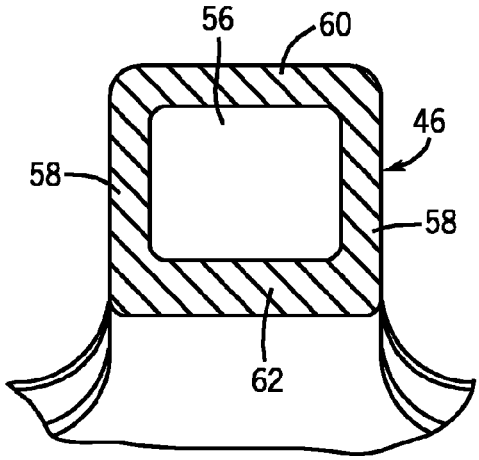
FIG. 3b PRIOR ART
FIG. 3*b* is a cross-section view of one arm of a prior art spider.

FIG. 3*b* illustrates a cross-section view of one of the spider arms 46. As illustrated in FIG. 3*b*, the spider arms 46 have a generally hollow central cavity 56. The cavity 56 is generally defined by two sidewalls 58, a top wall 60 and a bottom wall 62. The walls are formed from a durable steel material, typically formed by sand casting. During formation of the spider arms 46 of the prior art spider 44, sand cores must be supported within a mold during in the mold preparation process. Further, the enclosed cavity 56 must include upper access holes 64 and lower access openings 66 to provide access to the lubrication lines and mounting members for the spider arm guards 48 (FIG. 2). The access holes 64 are access openings 66 and are also used to pass support members for the sand cores during the formation of the spider. After casting, the access openings 66 are used to extract the remains of the core and provide access for inspection and repair operations for unacceptable defects. The access holes 64 and access openings 66 create weaknesses in the spider arms 46 and are sometimes points of fatigue cracking.

Figure 4:
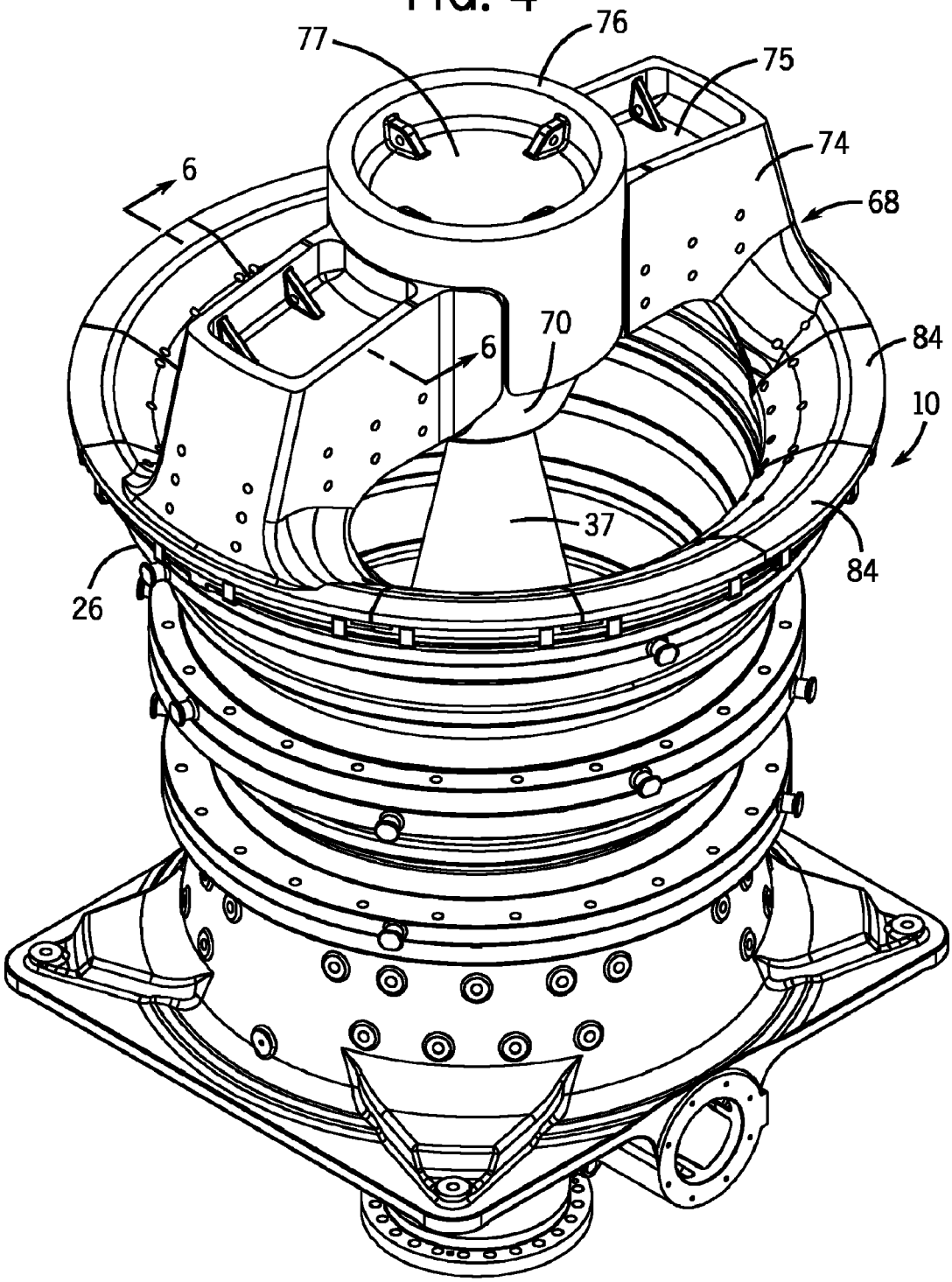
FIG. 4 is a perspective, assembled view of the spider of the present disclosure mounted to the shell assembly of a gyratory crusher.

FIG. 4 illustrates a spider assembly 68 constructed in accordance with the present disclosure. The spider assembly 68 is shown mounted to a gyratory rock crusher 10 that includes the same upper top shell 26 and mainshaft 38 as shown and described in FIG. 2. The rows of concaves are not shown in FIG. 4, but are also included in the rock crusher 10. As illustrated, the mainshaft 38 is supported by the central hub 70 in the same manner as previously described.

Figure 5:
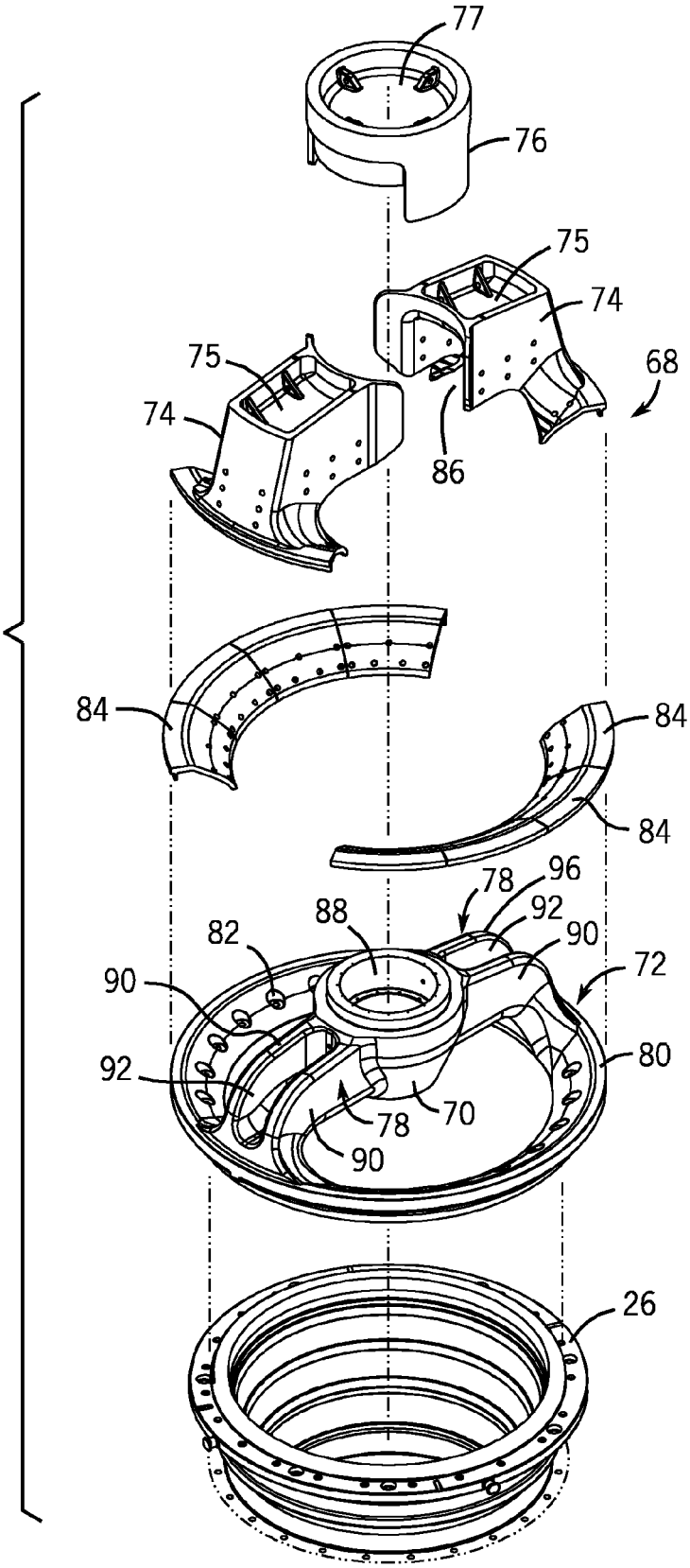
FIG. 5 is an exploded view of a portion of the gyratory crusher.

FIG. 5 provides an exploded view of the spider assembly 68. The spider assembly 68 generally includes the spider 72, a pair of spider arm shields 74, rim liners 84 and a spider cap 76.

The spider 72 includes a pair of spider arms 78 extending from the central hub 70 and joined to an outer rim 80. Outer rim 80 includes a series of mounting holes 82 that allow the spider 72 to be securely attached to the upper top shell 26. When the spider 72 is mounted to the upper top shell 26, a set of rim liners 84 are positioned over the outer rim 80 to provide wear resistance for the outer rim 80.

When the spider 72 is mounted to the upper top shell 26, spider arm shield 74 is mounted to each of the spider arms 78 to provide wear protection for the spider arm. As illustrated in FIG. 5, each of the spider arm shields 74 includes a channel 86 such that the spider arm shields 74 can be placed over the spider arms 78 to provide wear protection for the spider arms 78. Spider cap 76 extends over the central hub 70 and provides additional wear protection for the spider 72.

Each of the spider arm shields 74 includes a dead bed 75 formed on the top of the arm shield. The dead bed 75 accumulates some of the material being crushed such that when additional material moves toward the spider, the material contacts the accumulated material in the dead bed 75 to reduce wear on the arm shield 74. The spider cap 76 includes a similar dead bed 77 that functions in the same manner. Although the embodiment shown in the Figures includes the dead beds 75 and 77, the dead beds could be eliminated from the design while operating within the scope of the present disclosure.

Figure 6:
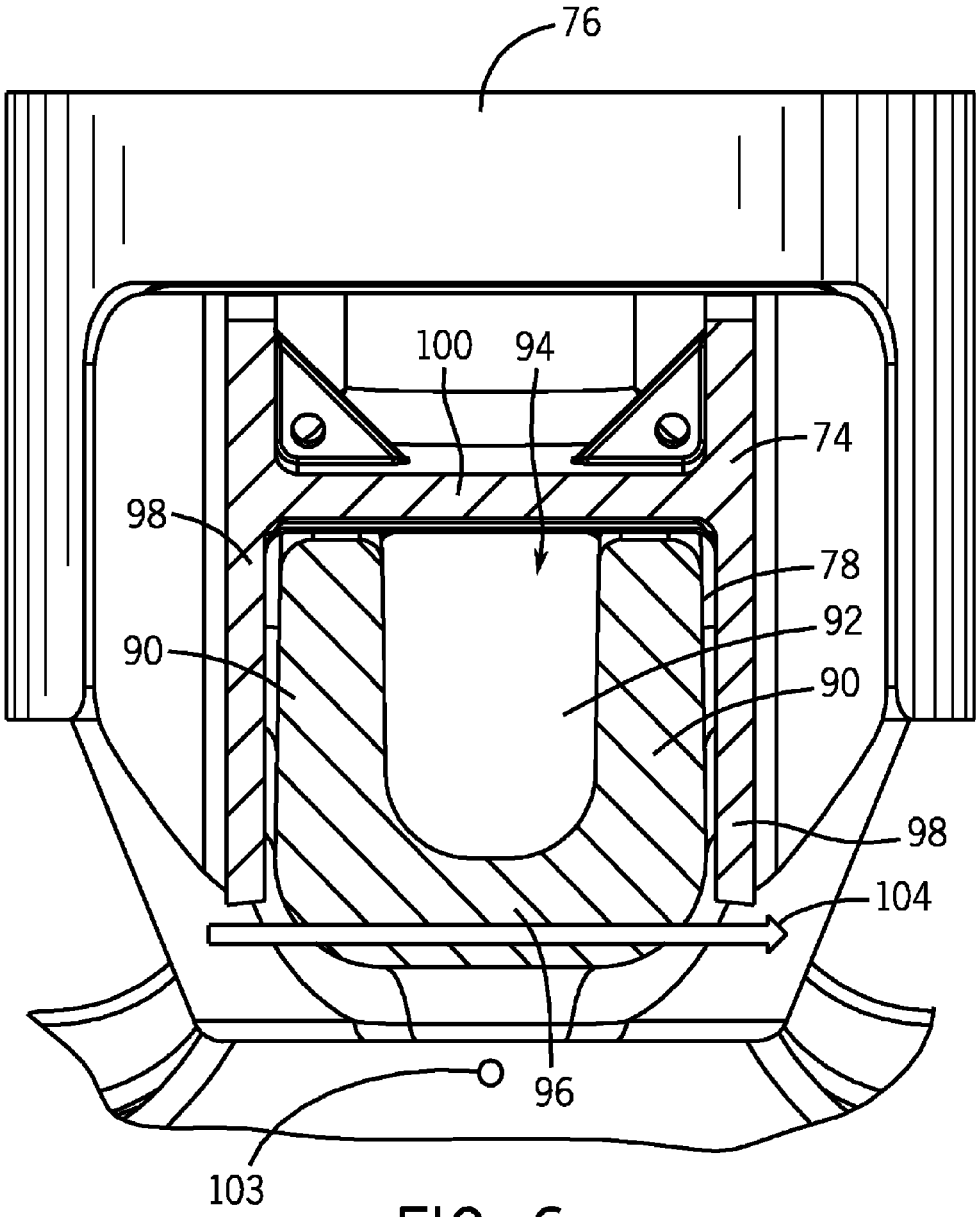
FIG. 6 is a section view taken along line 6-6 of FIG. 4.

Referring to FIG. 6, the spider arm shields 74 includes a pair of spaced sidewalls 98 that are positioned adjacent to each of the spider arm flanges 90 and are connected by a top web 100. The top web 100 extends over the top end 94 of the spider arm 78 to prevent material and debris from entering into the channel 92 formed between the pair of spaced flanges 90. The specific configuration of the spider arm shield 74 can be modified depending upon the actual shape of the spider arm 78. The top web 100 includes the dead bed 75 as previously described.

As shown in FIGS. 5 and 6, each of the spider arms 78 is formed from a pair of spaced flanges 90. The spacing between the flanges 90 defines a channel 92. As illustrated in FIGS. 5 and 6, channel 92 is open at a top end 94 and closed at a bottom end by a connecting web 96. The connecting web 96 extends between the pair of spaced flanges 90 and is integrally formed with the flanges 90. The combination of the pair of flanges 90 and the channel 92 results in each of the spider arms generally having the structural characteristics of a beam extending from the central hub 70 to the outer rim 80.

The spider arms 78 function as structural members to support the central hub 70 having an upper bushing which in turn supports the upper end of the mainshaft 38. Crushing forces on the mantle are transmitted to the mainshaft, resulting in reactive forces at the upper bushing where the forces are transmitted to the central hub 70. The forces are generally horizontal and vary in magnitude and direction as dictated by the gyrational motion of the mainshaft and the crushing resistance of the rock in the crushing cavity. Accordingly, the loads imposed upon the spider are sometimes transverse, in whole or in part and of either sense, to the direction defined by the length of the spider arms 78 and hub 70 spanning the outer rim. All loads from the mainshaft carried by the spider arms 78 must be equilibrated by support forces at the junctions of the arms to the outer rim and the upper top shell, but the transverse force components are most critical regarding deformations and stresses in the spider arms 78. The internal loads carried by the spider arms 78 cause a variety of deformations including bending, extension, and shear, but twisting deformations and associated stresses due to transverse loads can be the most damaging to open sections. However, the open channel configuration of the spider arms 78 shown in FIGS. 5 and 6 is effective in reducing twisting deformations and stresses to acceptable magnitudes without resorting to significantly larger alternative open cross sections that would impede the functionality of the crusher and the manufacturing economy of the spider.

The shear center for a beam is a point on a cross section where a transverse force can be applied without inducing any torsional deformations on the beam. In general, open sections are more vulnerable to torsional stresses and deformations than closed sections, such as circular or rectangular tubes. The shear center is the location through which transverse forces must be applied to minimize torsional effects that increase with offset distance between the line of force application and the shear center.

In the embodiment shown in FIG. 5, each spider arm can be characterized as a beam that supports the central hub inside the outer rim of the spider. Each spider arm can be represented as a straight line between the point of force application at the bushing of the central hub and the region of support on the outer rim. This straight line can be considered a beam as the term is related to the theory of engineering mechanics. Using such analysis, the shear center for the beam cross section illustrated is located near or slightly beneath the connecting web 96 and is generally shown by reference numeral 103 in FIG. 6. During operation of the gyratory rock crusher, the gyrating mainshaft creates a transverse component of force that is imposed on the spider. The transverse component of force is generally illustrated in FIG. 6 by arrow 104. As illustrated, the location of the transverse component of force is near the shear center 103. Due to the proximity of the transverse force and the shear center, the spider arm including the open channel 92 formed between the pair of spaced flanges 90 and the web 96 provides the required structural characteristics to resist torsional deformation and associated stresses due to transverse loads.

The configuration of the spider 72 having the open channel between the pair of spaced flanges 90 and the web 96 greatly reduces the complexity of the manufacturing process, which reduces the cost of producing the spider. Unlike the prior art spider 44 including the enclosed spider arms 46 shown in FIG. 3*a*, the spider of the present disclosure does not require special cores and opening to form the enclosed cavity 56, which simplifies the manufacturing process. The construction of the spider arms 78 using a pair of spaced flanges 90 that define an open channel also allows for easier access to all lubrication lines and connections without having to form the access holes and openings shown and described in the prior art spider of FIG. 3*a*. The open channel 92 allows greater access to these components while yet providing the required strength and durability for the spider 72.

Figure 7:
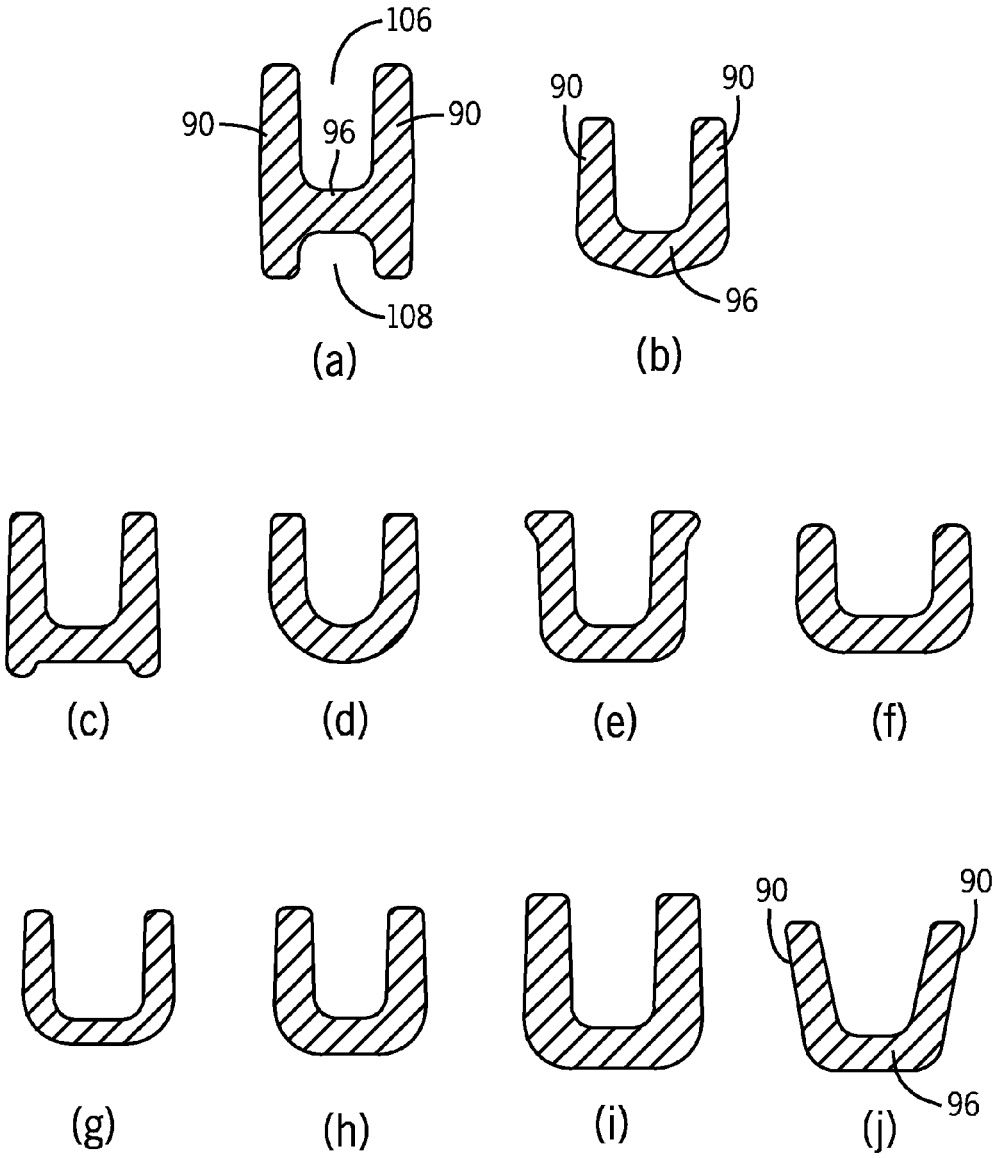
FIG. 7 is a series of sectional views of alternate embodiments of the cross-sectional shape of spider arms constructed in accordance with the present disclosure.

FIG. 7 illustrates many different alternate embodiments for the cross-section of each of the spider arms. In the embodiment shown in FIGS. 7*a*-7*j*, the cross-section of each of the spider arms is generally U-shaped in which the pair of spaced flanges 90 are joined by the connecting web 96. The connecting web 96 is generally positioned low on the cross section and extends between the spaced flanges 90. Although the embodiment of FIGS. 7*a*-7*j* are described as being generally U-shaped, it should be understood that the term "U-shaped" refers to a shape having a pair of upwardly extending flanges 90 separated by an open channel and joined at a lower end by a transverse connecting web 96.

FIG. 7*a* illustrates an alternate embodiments that include both an open upper channel 106 and an open lower channel 108 separated by the connecting web 96. In each of the embodiments shown in FIGS. 7*a*-7*j*, the spider arm includes a channel having one end open, which is contrary to the enclosed spider arms of the prior art as shown in FIG. 3*b*. In the embodiment of FIG. 7*j*, the flanges 90 are not parallel.

Although the spider 72 is shown and described in the present disclosure as being used with a gyratory crusher, it should be understood that a similar structural component is sometimes used with cone crushers. It is contemplated that the design of the present disclosure could also be used with a cone crusher.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A spider for use with a gyratory crusher, comprising:

a central hub; and a plurality of spider arms extending from the central hub to an outer rim, wherein each of the spider arms has a generally U-shaped cross-section including an upwardly open channel defined by a pair of spaced flanges joined to each other by a connecting web, wherein a shear center of the U-shaped cross-section is located below the connecting web.

2. The spider of claim 1 wherein the spaced flanges and the connecting web are integrally formed.

3. A gyratory crusher, comprising:

a shell assembly;

a spider supported by the shell assembly, the spider having a central hub and a plurality of spider arms extending from the central hub to an outer rim, each of the spider arms having a generally U-shaped cross-section including an upwardly open channel being formed by a pair of flanges spaced from each other to define a channel and are joined to each other by a connecting web, wherein a shear center of the U-shaped cross-section is located below the connecting web; and a plurality of spider arm shields each mounted to one of the spider arms.

4. The gyratory crusher of claim 3 wherein the flanges and the connecting web are integrally formed.

5. The gyratory crusher of claim 3 further comprising a mainshaft supported at one end by the central hub, wherein movement of the mainshaft within the shell creates a force on the spider.

6. The gyratory crusher of claim 3 wherein each of the spider arm shields covers the open top end of the channel formed by the spaced flanges to prevent debris from entering into the open channel.

7. The gyratory crusher of claim 6 wherein each of the spider arm shields includes a recessed dead bed formed in a top web of the spider arm shield that accumulates material being crushed to reduce wear on the spider arm shields.

8. The gyratory crusher of claim 7 further comprising a spider cap positioned over the central hub, the spider cap including a recessed dead bed that accumulates material being crushed to reduce wear on the spider cap.

9. A spider for use with a gyratory crusher, comprising:

a central hub; and a plurality of spider arms extending from the central hub to an outer rim, wherein each of the spider arms includes a pair of flanges spaced from each other and joined at one end by a connecting web, wherein the spaced flanges and the connecting web define a generally U-shaped cross-section for each spider arm, wherein a channel formed between the pair of spaced flanges is open at an end vertically above the connecting web, wherein a shear center of the U-shaped cross-section is located below the connecting web.

* * * * *